United States Patent [19]

Wheat

[11] 4,272,090

[45] Jun. 9, 1981

[54] ROLLER SKATE

[76] Inventor: Ira N. Wheat, P.O. Box 145, Quitman, Tex. 75784

[21] Appl. No.: 18,998

[22] Filed: Mar. 9, 1979

[51] Int. Cl.[3] ..... A63C 17/04

[52] U.S. Cl. ..... 280/11.22; 280/11.28; 280/686

[58] Field of Search ..... 280/11.19, 11.22, 11.2, 280/11.27, 11.28, 87.04 R, 87.04 A, 686, 11.23

[56] References Cited

U.S. PATENT DOCUMENTS

| | | | |
|---|---|---|---|
| 1,975,905 | 10/1934 | Specht | 280/11.22 |
| 3,361,443 | 1/1968 | Wolf | 280/686 |

FOREIGN PATENT DOCUMENTS

| | | | |
|---|---|---|---|
| 314645 | 10/1919 | Fed. Rep. of Germany | 280/11.2 |
| 492509 | 3/1954 | Italy | 280/11.23 |

*Primary Examiner*—John J. Love
*Assistant Examiner*—D. W. Underwood
*Attorney, Agent, or Firm*—Peter J. Murphy

[57] ABSTRACT

A shoe skate includes a single row of in-line wheels or rollers, mounted on the shoe as front and rear wheel units. The front wheel unit includes a bogie pivoted about a transverse axis and carrying leading and trailing wheels, enabling the skater to maintain these wheels in contact with the skating surface where the heel of the shoe is raised. The rear wheel unit is mounted on the heel of the skating shoe. A leaf spring bears on the opposite ends of the bogie, to maintain the bogie in a normal stable condition relative to the shoe.

1 Claim, 3 Drawing Figures

ROLLER SKATE

BACKGROUND AND SUMMARY OF THE INVENTION

This invention relates to a roller skate; and more particularly to a shoe skate for floor surface use, having wheels to simulate the runner of a figure skate for ice surface use.

An object of this invention is to provide a form of roller skate having a single, in-line row of rollers or wheels.

Another object of this invention is to provide a form of roller skate which simulates an ice skate for figure skating use.

A further object of this invention is to provide a form of roller skate for floor surface use which enables the simulation of skating on ice.

Still another object of this invention is to provide a form of roller skate having a single, in-line row of rollers or wheels, including a front pivoted bogie which carries a pair of wheels.

Another object of this invention is to provide a form of roller skate which allows the skater to use both knee action and toe action in accelerating and maintaining a high speed.

A still further object of this invention is to provide a form of roller skate having a single, in-line row of rollers or wheels, including a pivoted front wheel assembly providing for stable floor contact when the heel of the skating shoe is raised.

These objects are accomplished in a roller skate which comprises a shoe having a sole portion and a heel portion, a front wheel assembly mounted at the sole portion, and a rear wheel assembly mounted at the heel portion. The front wheel assembly comprises: a base plate attached to the sole portion, having means defining a pivot mount; an elongated bogie, having pivot means intermediate its ends for attachment to the pivot mount; and leading and trailing wheels rotatably mounted at the opposite ends of the bogie. The rear wheel assembly comprises: a base plate attached to the heel portion of the shoe, having means defining a wheel mount; and a rear wheel rotatably mounted in said wheel mount. The leading, trailing, and rear wheels are aligned in a single row about parallel axes of rotation. More particularly, spring means provides a coupling between the front wheel assembly base plate and the bogie for establishing a normal position of the bogie relative to the base plate.

The novel features and the advantages of the invention, as well as additional objects thereof, will be understood more fully from the following description when read in connection with the accompanying drawing.

DRAWING

DESCRIPTION OF THE PREFERRED EMBODIMENT

Figure 1:
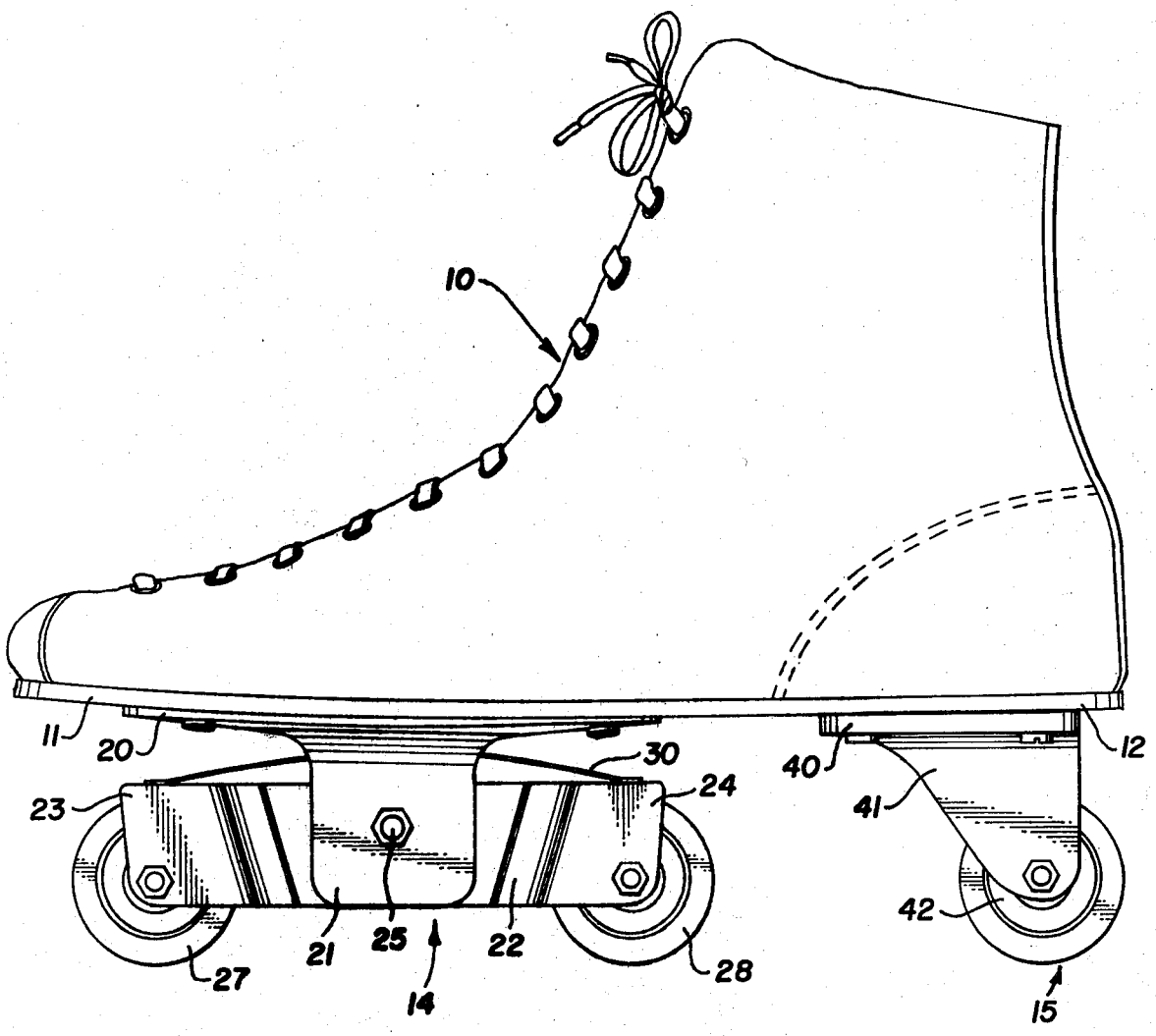
FIG. 1 is a side elevation view of a skate according to the invention.
Figure 2:
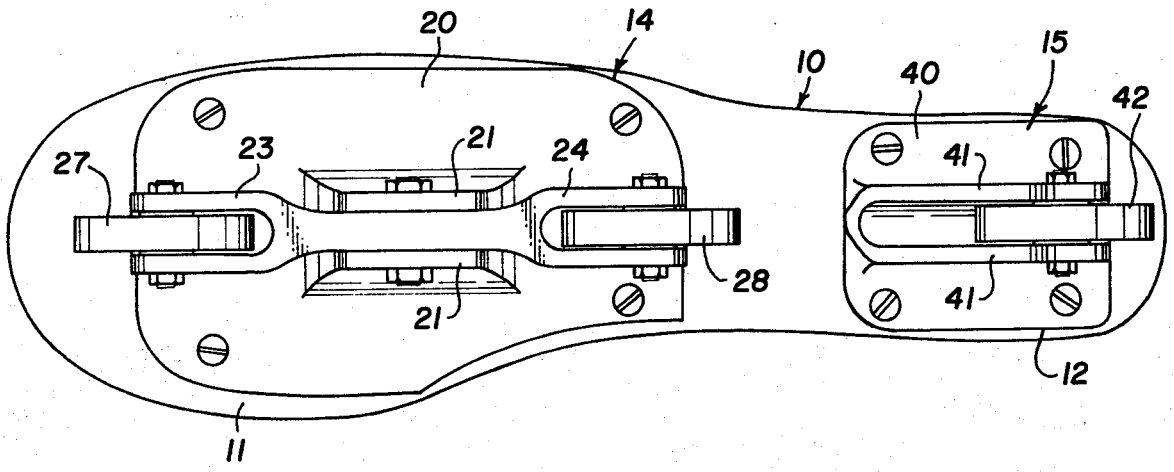
FIG. 2 is a bottom view of the skate of FIG. 1.

Referring to the drawing, the roller skate consists of a shoe 10 of the type conventionally used for roller skates or ice skates, including the usual sole portion 11 and heel portion 12. In the illustrated form, the skate includes a front wheel assembly 14 and a rear wheel assembly 15 which are individual assemblies.

The front wheel assembly includes a base plate 20 having a flat plate portion configured to be attached to the sole portion 11 of the shoe in any suitable manner, and has integral ears 21 projecting from the exposed face of the base plate and providing a pivot mount. The base plate may be fabricated from any suitable material such as stainless steel. A bogie 22, for supporting a pair of wheels, is an elongated member having yokes 23 and 24 at opposite ends providing wheel mounts. The bogie has structure, intermediate its ends coacting with the ears 21 to provide a suitable pivot bearing structure 25 for the bogie. Leading and trailing wheels 27 and 28 are rotatably mounted in the yokes 23 and 24, respectively. The wheels may be fabricated from suitable material such as steel or urethane, for example, and are mounted in the yokes by means of suitable bearing structures.

Figure 3:
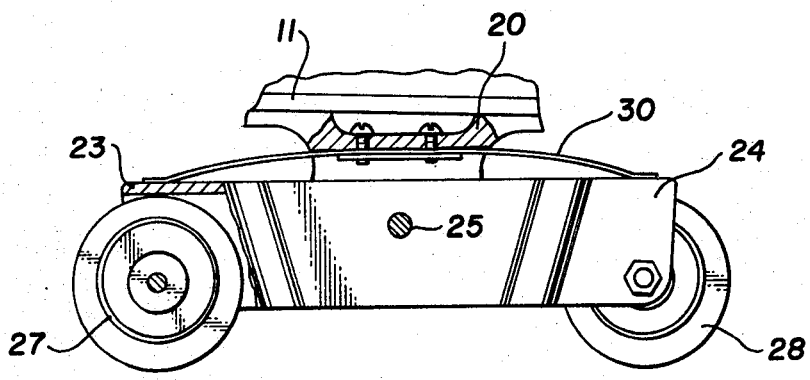
FIG. 3 is a detail view, partially broken away, of the front wheel assembly of the skate of FIG. 1.

As best seen in FIG. 3, the bogie 22 is maintained in a selected normal position by means of a spring 30 which is in the form of an elongated leaf. This leaf is rigidly secured at its center to the base plate 20, adjacent to the pivot structure 25; and the ends of the leaf bear on the bogie 22 adjacent to its ends. This spring, while allowing tilting of the bogie relative to the base plate, returns the bogie to the normal position for stability of the skate as will be described.

The rear wheel assembly 15 includes a base plate 40 configured for attachment to the heel portion 12 of the shoe, the base plate having integral ears 41 projecting from the exposed face and providing a wheel mount. A rear wheel 42 may have the same configuration as the front wheels 27 and 28; and is provided with suitable bearing structure for coaction with the ears 41.

While the front and rear wheel assemblies are described as individual assemblies, it will be understood that the base plates for these assemblies may be a number which is common to the two assemblies, that is a single base plate which is suitably attached to both the sole and heel portions of the shoe.

Preferably the spring 30 will maintain the wheels in alignment such that the rotational axes of the three wheels are in a common plane when the skate is lifted from the skating surface. This provides some stability for the front assembly bogie in the sense that when a skater engages the skate with the skating surface in a flat orientation, all three wheels will engage the skating surface simultaneously. When the skater desires to tilt forward relative to the skating surface, the bogie will tilt relative to the shoe and maintain both the leading and trailing wheels of the front wheel assembly in engagement with the skating surface for stability in performing certain maneuvers. With further forward tilting of the shoe, when the bogie has reached the limit of pivotal movement, the trailing wheel 28 may be raised from the skating surface enabling skating maneuvers on the leading wheel 27 only, for example.

What has been described is a novel form of roller skate, having a roller or wheel design particularly adapted to simulate the runner of a figure skate used for ice skating. A particular feature of this skate is the provision of a front wheel bogie assembly which functions to maintain a pair of aligned wheels in contact with the floor surface, when the rear wheel is raised slightly from the floor surface, providing greater stability of the skate for certain maneuvers in this position and also simulating more closely the contact of a usual figure skating blade with the ice in this orientation of the shoe. A particular advantage of this front wheel assembly is that it enables the skater to use, more readily, toe action and knee action for acceleration and for maintaining high speeds.

While the preferred embodiment of the invention has been illustrated and described, it will be understood by those skilled in the art that changes and modifications may be resorted to without departing from the spirit and scope of the invention.

What is claimed is:

1. A roller skate comprising a shoe having a sole portion and a heel portion; a front wheel assembly mounted at said sole portion; and a rear wheel assembly mounted at said heel portion;

said front wheel assembly comprising: a base plate attached to said sole portion having means defining a fixed pivot bearing underlying said sole portion; an elongated bogie, having means defining a fixed pivot bearing intermediate its ends for coacting attachment to said plate pivot bearing; and leading and trailing wheels rotatably mounted at the opposite ends of said bogie, and disposed beneath said sole portion;

spring means coupled between said front wheel assembly base plate and said bogie, for establishing a normal rotative position of said bogie relative to said base plate when the wheels are lifted from the skating surface; said spring means comprising an elongated spring leaf secured rigidly to said base plate intermediate its ends, and having its opposite ends bearing on said bogie adjacent to the respective opposite ends thereof;

said rear wheel assembly comprising: a base plate attached to said heel portion having means defining a wheel mount underlying said heel portion; and a rear wheel rotatably mounted in said wheel mount;

said leading, trailing, and rear wheels being aligned in a single row about parallel axis of rotation.

* * * * *